US009090371B2

(12) United States Patent
Hallam et al.

(10) Patent No.: US 9,090,371 B2
(45) Date of Patent: Jul. 28, 2015

(54) CARTONS

(75) Inventors: Chris Hallam, Bradford (GB); Mayur Mistry, Bradford (GB)

(73) Assignee: Concept Packaging Service Limited, Bradford (GB)

( * ) Notice: Subject to any disclaimer, the term of this patent is extended or adjusted under 35 U.S.C. 154(b) by 108 days.

(21) Appl. No.: 13/816,365

(22) PCT Filed: Aug. 10, 2011

(86) PCT No.: PCT/GB2011/051507

§ 371 (c)(1),
(2), (4) Date: Apr. 17, 2013

(87) PCT Pub. No.: WO2012/020256

PCT Pub. Date: Feb. 16, 2012

(65) Prior Publication Data

US 2013/0193196 A1 Aug. 1, 2013

(30) Foreign Application Priority Data

Aug. 10, 2010 (GB) ..... 1013395.7
Aug. 20, 2010 (GB) ..... 1013951.7
Sep. 10, 2010 (GB) ..... 1015051.4

(51) Int. Cl.
*B65D 3/14* (2006.01)
*B65D 5/02* (2006.01)
(Continued)

(52) U.S. Cl.
CPC ... *B65D 5/00* (2013.01); *B31B 3/00* (2013.01); *B65D 3/04* (2013.01); *B65D 3/14* (2013.01); *B65D 3/20* (2013.01); *B65D 5/0209* (2013.01); *B65D 5/0245* (2013.01); *B65D 5/3621* (2013.01)

(58) Field of Classification Search
CPC ..... B65D 3/04; B65D 3/14; B65D 3/20; B65D 5/0209; B65D 5/0245; B65D 5/3621
USPC ..... 229/104, 117, 117.06, 122.27, 122.28, 229/122.31
See application file for complete search history.

(56) References Cited

U.S. PATENT DOCUMENTS 1,184,956 A * 5/1916 Hoppke ..... 229/104
2,189,436 A * 2/1940 Rosenfield ..... 229/117.01
(Continued)

FOREIGN PATENT DOCUMENTS

EP 626317 A1 * 11/1994 ..... B65D 5/02
EP 2165938 3/2010
(Continued)

*Primary Examiner* — Gary Elkins
(74) *Attorney, Agent, or Firm* — Trego, Hines & Ladenheim, PLLC

(57) ABSTRACT

There is provided a carton comprising a side wall (4) comprising a first panel (6) connected to a second panel (8), a first lower flap (16) hingedly connected to the first panel, the first and second panels having free ends, a second lower flap (18) hingedly connected to the second panel, a hinged locking base panel (30) hingedly connected to the first lower panel and an inner base panel (36) hingedly connected to the second lower panel, a plurality of strengthening tabs (54,56,58,60) attached to the hinged base locking panel or the inner base panel, the first lower flap being folded over and affixed to the first panel, the second lower flap being folded over and affixed to the second panel, the hinged base locking panel being folded along a hinge line (34) thereof and affixed to the inner base panel, in which substantially diagonal weakening lines (80,82,84,86) are positioned on the lower flaps.

13 Claims, 4 Drawing Sheets

(51) Int. Cl.

| | |
|---|---|
| ***B65D 5/00*** | (2006.01) |
| ***B65D 3/04*** | (2006.01) |
| ***B65D 5/36*** | (2006.01) |
| ***B65D 3/20*** | (2006.01) |
| ***B31B 3/00*** | (2006.01) |

(56) References Cited

U.S. PATENT DOCUMENTS

| | | | | | |
|---|---|---|---|---|---|
| 2,226,178 | A | * | 12/1940 | Page | 229/5.5 |
| 3,269,640 | A | * | 8/1966 | Arneson | 229/106 |
| 3,912,331 | A | * | 10/1975 | Turner et al. | 229/104 |
| 3,930,607 | A | * | 1/1976 | Smith | 229/5.5 |
| 4,109,848 | A | * | 8/1978 | Kipp et al. | 229/104 |
| 5,348,145 | A | | 9/1994 | Steinfels, III | |
| 6,003,759 | A | * | 12/1999 | Kenner et al. | 229/104 |
| 6,170,740 | B1 | * | 1/2001 | Clark | 229/117.04 |
| 7,578,426 | B2 | * | 8/2009 | Wende et al. | 229/4.5 |
| 2007/0138247 | A1 | * | 6/2007 | Fitzwater | 229/242 |

FOREIGN PATENT DOCUMENTS

| | | |
|---|---|---|
| GB | 2451281 | 1/2009 |
| WO | 0076858 | 12/2000 |

* cited by examiner

CARTONS

FIELD OF THE INVENTION

The present invention relates to cartons, to blanks suitable for the construction of such cartons and to methods of manufacturing cartons.

BACKGROUND TO THE INVENTION

Round, oval or curved paperboard containers are commonly used in packaging a variety of articles such as bottles, cookies, confectionery, granular foodstuffs, potato chips and other such articles/items. The majority of these containers are manufactured in remote locations and shipped in a set up form to the point of product packing. In other cases expensive dedicated machinery is set up at the side of the packing operation to manufacture the containers and thus avoid the shipping costs and associated logistical problems.

Square or rectangular containers however are produced using folding carton technology and these containers are shipped flat to the point of packing. Such containers can be easily erected by hand or by simpler less expensive machinery.

GB 2 451 281 discloses a round or curved carton. This carton however has a complicated base structure which is difficult and costly to glue into its desired flat or knock down state.

GB 2 451 281 suffers from a weakness also in that it is possible to apply pressure from the base and push the base section back up inside the carton returning it partially or substantially to its knock down state.

GB 2 451 281 has a base which externally is made up of several independent panels. It is difficult to position graphical information on the base without having to use one or more of these panels. For images such as barcodes it is not possible to split the image over one or more panels. On very small diameters there is often insufficient space to position necessary text and this information has to be printed on the sidewall of the carton which is designed to be reserved for more pleasing imagery. GB 2 451 281 also discloses a less complicated base but this base suffers from certain weaknesses which the present invention overcomes.

It is therefore an aim of preferred embodiments of the present invention to obviate or overcome a disadvantage of the prior art, whether such prior art or disadvantage is referred to herein or otherwise.

SUMMARY OF THE INVENTION

According to the present invention in a first aspect there is provided a carton comprising a side wall comprising a first panel connected to a second panel, a first lower flap hingedly connected to the first panel, the first and second panels having free ends, a second lower flap hingedly connected to the second panel, a hinged locking base panel hingedly connected to the first lower panel and an inner base panel hingedly connected to the second lower panel, a plurality of strengthening tabs attached to the hinged base locking panel or the inner base panel, the first lower flap being folded over and affixed to the first panel, the second lower flap being folded over and affixed to the second panel, the hinged base locking panel being folded along a hinge line thereof and affixed to the inner base panel, in which substantially diagonal weakening lines are positioned on the lower flaps.

The substantially diagonal weakening lines are positioned on the lower flaps to further serve to open up the ends of the lower flaps to accommodate the strengthening tabs. It will be appreciated that if any one of the strengthening tabs fails to locate within the space between the lower flap and the outer side wall then the carton would be substandard and potentially unsuitable for use. Preferably the weakening lines are positioned so as to lie outside of the pocket area occupied by the strengthening tab when the carton is in its final made up condition. The weakening lines are substantially diagonal so as to avoid unsightly cracking or creasing on the outside of the made up carton. If the weakening lines were to run perpendicular to the fold line joining the lower panel to the side wall then the carton would show a crease on the outside face of the side wall. The use of a substantially diagonal line allows the lower flap to move away from the side wall by a greater distance and still allow the side wall to maintain a smooth curved appearance on its outermost face.

Suitably, the weakening lines overlie the strengthening tabs when the carton is in its final made up condition.

According to the present invention in a second aspect there is provided a carton comprising a side wall comprising a first panel connected to a second panel, a first lower flap hingedly connected to the first panel, the first and second panels having free ends, a second lower flap hingedly connected to the second panel, a hinged locking base panel hingedly connected to the first lower panel and an inner base panel hingedly connected to the second lower panel, a plurality of strengthening tabs attached to the hinged base locking panel or the inner base panel, the first lower flap being folded over and affixed to the first panel, the second lower flap being folded over and affixed to the second panel, the hinged base locking panel being folded along a hinge line thereof and affixed to the inner base panel, in which there are further short creases on the lower flaps.

The short creases further serve to hold the lower flap away from the side wall.

The following optional features apply to the first and second aspects of the invention.

Suitably, the hinged base locking panel is substantially circular in cross sectional shape and has a plurality of strengthening tabs attached by fold lines positioned either side of the central fold line.

Suitably the hinged locking base panel and the inner base panel can be a variety of curved and non curved cross sectional shapes.

Suitably, the first and/or second lower flaps are glued to the first and/or second panel of the side wall in a central section only. This can be just where the hinged locking base panel and hinged base panel connect with the lower flaps. Clearly, the glue should not extend beyond the start of the diagonal lines or into the weakened area into which the strengthening tabs will lie in a made up state. The connection between the lower flaps and the side wall is suitably made by a creased line. The connection can be made by a combination of a partial cut or score combined with a creased section. It is preferable though that the free ends of the connection are made by a creased line. The use of a crease in this section in conjunction with leaving the lower flap unglued has the effect of pushing the lower flap away from the side wall to create a gap for the strengthening tabs to locate between.

Suitably, the free ends of the lower flaps are designed so as to create a pocket open at one end to cooperate with the one or more strengthening tabs on the hinged locking base panel when the carton is erected into its final made up state.

Suitably, the base comprises a base panel hingedly connected to a side wall panel. Suitably, the base is hingedly connected to a side panel (which may be via an intermediate flap) by a curved hinge connection. Suitably, the curvature of the curved hinge connection corresponds to the curvature of the side wall of the carton. Suitably, the hinged locking base panel is hingedly connected to a side wall panel. Suitably, the hinged base locking panel is hingedly connected to a side panel (which may be via an intermediate flap) by a curved hinge connection. Suitably, the curvature of the hinged connection corresponds to the curvature of the side wall of the carton. Suitably, the hinged base panel is connected to the locking base panel. Suitably, the hinged locking base panel is hinged with a hinge line substantially perpendicular to a hinge between the first panel and another panel.

According to the present invention in a third aspect there is provided a method of construction of a carton from a blank, the blank comprising a side wall having free ends, the side wall comprising a first panel connected to a second panel, a first lower flap hingedly connected to the first panel, a second lower flap hingedly connected to the second panel, a hinged base panel connected to the first lower panel and a base locking panel hingedly connected to the second lower panel, the method comprising the steps of folding the first lower flap above the first panel, folding the second lower flap over the second panel, folding the hinged locking base panel about the central crease line, affixing part of the of the reverse of the hinged base panel to a corresponding part of the face of the base locking panel comprising folding the first and second panels relatively towards each other, fixing the free ends of the side wall and moving the hinged locking base panel and the inner base panel to form a base of the carton, in which substantially diagonal weakening lines are positioned on the lower flaps.

Where there are two panels forming the side wall, the free end of the first panel is affixed to the free end of the second panel, but if there are more than two panels, the relevant free ends are fixed together.

According to the present invention in a fourth aspect there is provided a method of construction of a carton from a blank, the blank comprising a side wall having free ends, the side wall comprising a first panel connected to a second panel, a first lower flap hingedly connected to the first panel, a second lower flap hingedly connected to the second panel, a hinged base panel connected to the first lower panel and a base locking panel hingedly connected to the second lower panel, the method comprising the steps of folding the first lower flap above the first panel, folding the second lower flap over the second panel, folding the hinged locking base panel about the central crease line, affixing part of the of the reverse of the hinged base panel to a corresponding part of the face of the base locking panel comprising folding the first and second panels relatively towards each other, fixing the free ends of the side wall and moving the hinged locking base panel and the inner base panel to form a base of the carton, in which there are further short creases on the lower flaps.

Where there are two panels forming the side wall, the free end of the first panel is affixed to the free end of the second panel, but if there are more than two panels, the relevant free ends are fixed together.

Preferred embodiments of the present invention provide the advantage of combining the logistical and associated cost benefits of folding carton technology with the aesthetic benefits of curved shapes.

A second advantage of preferred embodiments of the present invention is to provide a curved container with a strong and substantially flat base which is less complicated in its construction and method of manufacture.

A third advantage of preferred embodiments of the present invention is to provide a substantially flat strong base construction for a curved carton which resists being knocked down once it has been set up.

A fourth advantage of preferred embodiments of the present invention is to provide a solid uninterrupted base which is substantially flat for a curved carton.

BRIEF DESCRIPTION OF THE DRAWINGS

The present invention will now be described, by way of example only, with reference to the accompanying drawings; in which.

DESCRIPTION OF THE PREFERRED EMBODIMENTS

Figure 1:
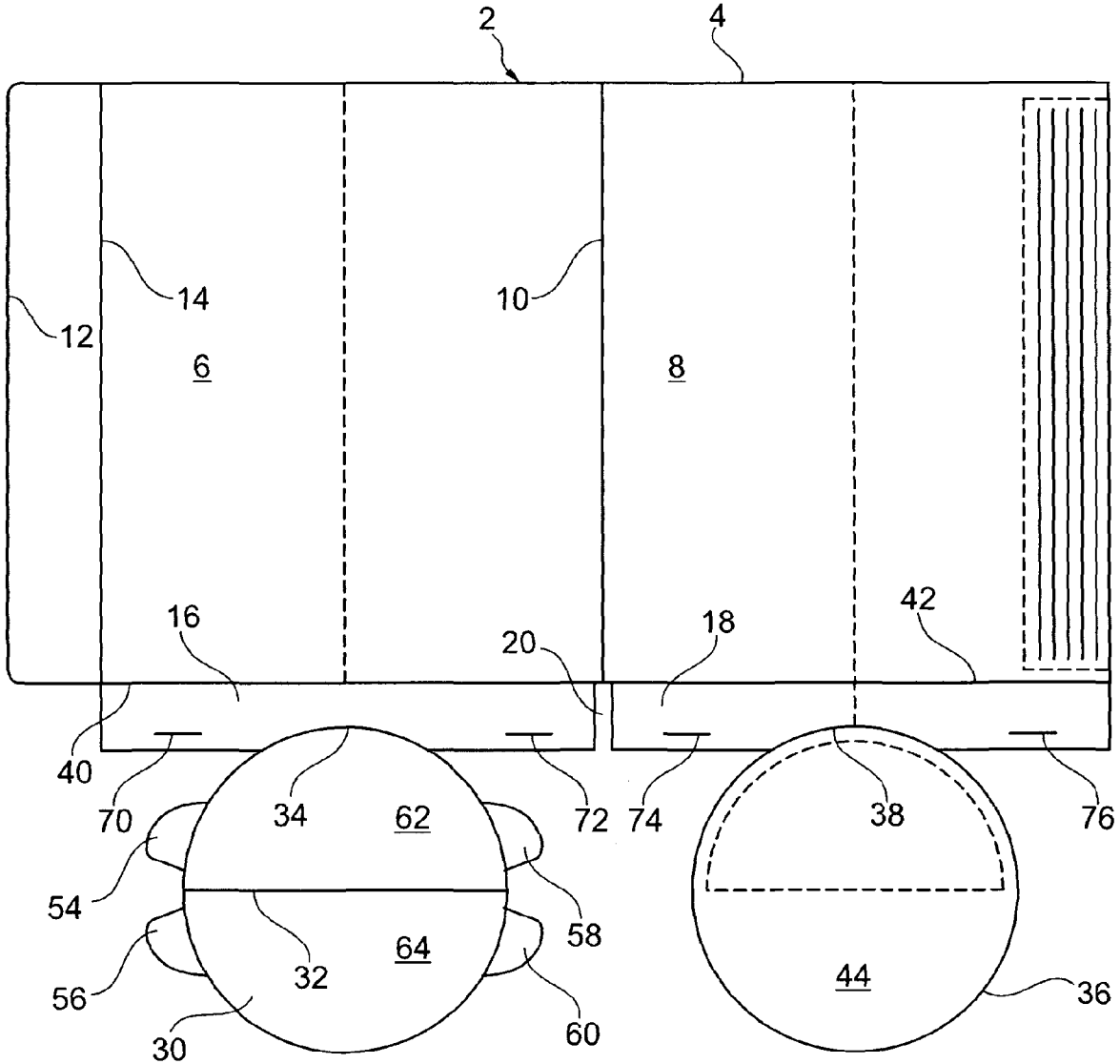
FIG. 1 is a plan view of a blank for producing a carton according to the present invention.

Referring to FIG. 1 of the accompanying drawings, there is shown a one piece carton board blank 2 comprising a side wall 4. The side wall 4 comprises a first panel 6 and a second panel 8. In this case, the second panel 8 is also an end panel. First panel 6 is generally rectangular and is hingedly connected to the similarly shaped second panel 8 by a fold line 10 along an edge thereof forming a hinged connection therebetween. Extending from the short edge of the first panel 6 distant from fold 10 is glue flap 12 connected to the first panel 6 by fold line 14.

First panel 6 includes a lower flap 16. Second panel 8 also includes a corresponding lower flap 18. The lower flaps 16, 18 are not connected edge-wise, being separated by a slot 20, but are hingedly connected to first panel 6 and second panel 8, respectively, by hinge lines 40, 42 respectively.

Extending from lower flap 16 is a hinged locking base panel 30, with a hinge line at 32, which hinged locking base panel 30 is hingedly connected to lower flap 16 by a curved fold line 34. The portion of the base panel defined by crease lines 32 and 34 forms a first part of said base panel 62 and the remainder of said base panel 30 forms a second part 64 of said base panel 30.

Extending from base panel 30 are four strengthening tabs 54, 56, 58, 60.

Also extending from lower flap 18 is an inner base panel 36 hingedly connected to lower flap 18 by a curved fold line 38.

Lower flap 16 is hinged to first panel 8 by a hinge line 40. Fold line 40 is formed as a partial cut but at its extreme ends the fold is made by use of a crease. This has the effect of forcing the ends of the lower panel 16 away from the panel 6 to create a gap where the free ends of the lower flaps 16, 18 are held away from the side wall 4 allowing the strengthening tabs 54, 56, 58, 60 to slide between the lower flaps 16, 18 and the side wall 4 when the carton is erected as described below.

It is possible to create the fold line 32 as a continuous crease and achieve the same result.

In a preferred embodiment there are also provided short reverse crease lines 70, 72, 74, 76 which serve to further force the lower flaps 16, 18 away from the side wall 4.

A method of construction of the blank 2 as described above will now be set out. Typically construction is carried out using carton gluing machinery but can be done by hand also.

Adhesive is applied to the reverse of lower panels 16, 18 in a central section only and definitely not at the free ends. Next the lower flaps 16, 18 are folded towards the first and second panels 6, 8 respectively so that the adhesive applied on the flaps 16, 18 and panels 6, 8 are pressed together to form a neat lower edge.

The second part 64 of hinged base panel 30 is folded back initially away from first panel 6 so that the two parts 62, 64 of hinged based panel 30 lie in substantially face to face relationship.

Adhesive is applied to the reverse of the second part 64 of hinged base panel 30 or alternatively to the corresponding face of locking base panel 36.

Then the carton is folded about central crease line 10 and the outside glue flap 12 is moved to contact a strip of glue to form the loop of the carton. First and second panels 6, 8 are thereby fixedly connected to form a carton and locking base panel 36 is fixed to hinged locking base panel 30 as a result of the aforementioned application of adhesive.

The carton as described above can be transported in a flat configuration with panels 6, 8 pressed together and pushed into a useable configuration with pressure applied to fold lines 10 and 14. Here inner base panel 36 is pressed down towards the bottom of the carton to lock the carton into shape. The inner base panel 36 overlies the hinged locking base panel 30. The downward movement of the inner base panel 36 also brings about the folding of the strengthening tabs 54, 56, 58, 60 so that they are arranged almost vertically adjacent the side wall, astride the two main faces 10, 12 and lie between the sidewall and the lower flaps. This interengagement prevents the base being pushed back upwards and therefore prevents the carton from collapsing in use. In turn the hinged crease lines connecting the strengthening tabs 54, 56, 58, 60 to the hinged locking base panel 30 provide further strength to the base preventing it folding in either direction along crease line 32. The strengthening tabs are further encouraged to slide between the side wall 4 and lower flaps 16,18 by the positioning of short crease lines which further serve to hold the free ends of the lower flaps 16,18 away from the side wall 4.

Figure 2:
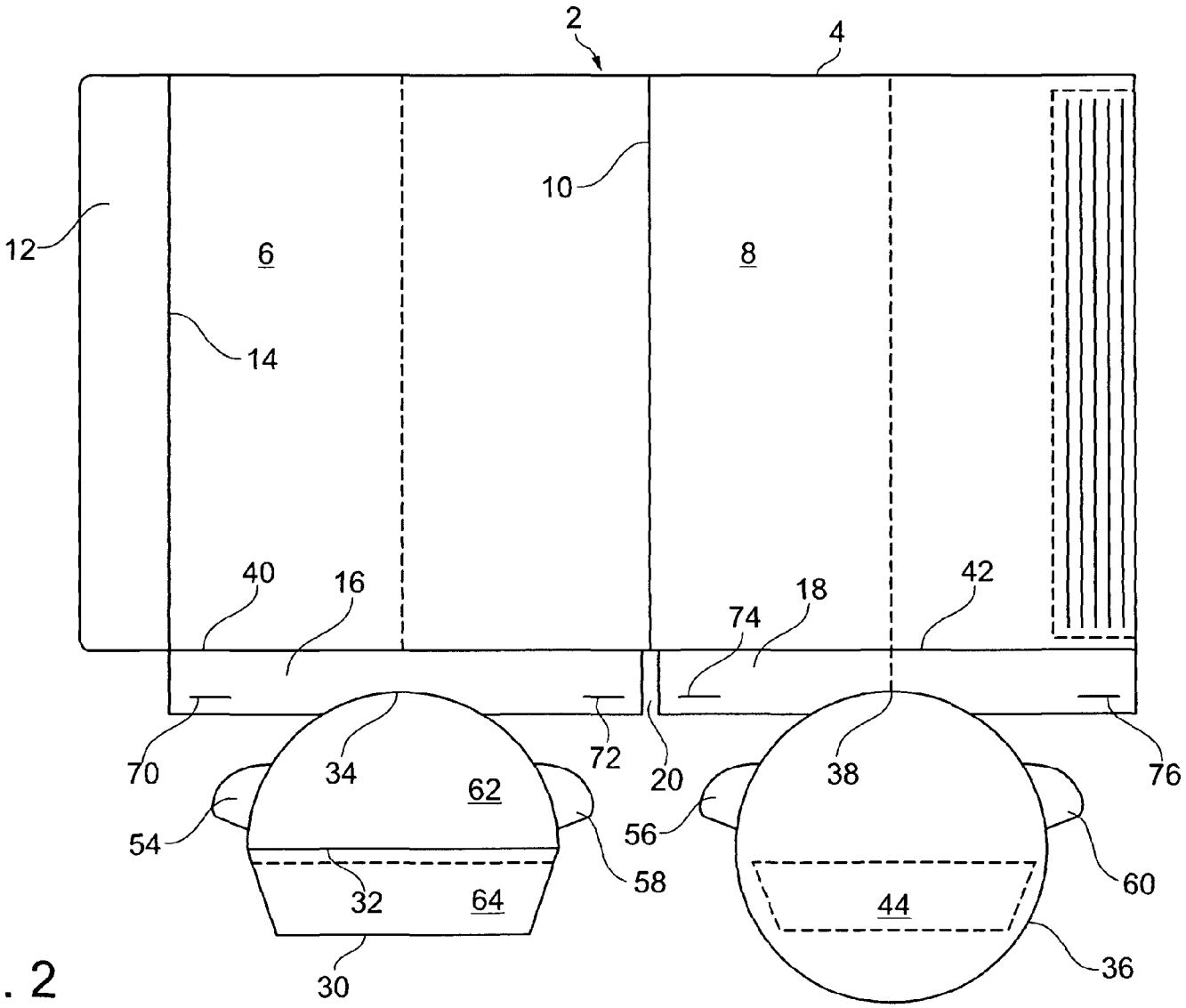
FIG. 2 is a plan view a blank for producing a carton according to the present invention according to a second embodiment.

Referring to FIG. 2 there is shown an alternative embodiment. In this embodiment there is no requirement to fold back the second part 64 of hinged locking base panel 30 prior to gluing to inner base panel 36. This has an advantage in terms of the mechanical gluing operation in that it makes it less complex.

In this second embodiment the strengthening tabs 56 and 60 are removed from the hinged locking base panel 30 and repositioned in an appropriate position on inner base panel 36. The form and function of these strengthening tabs 56 and 60 are identical in either embodiment.

Figure 3:
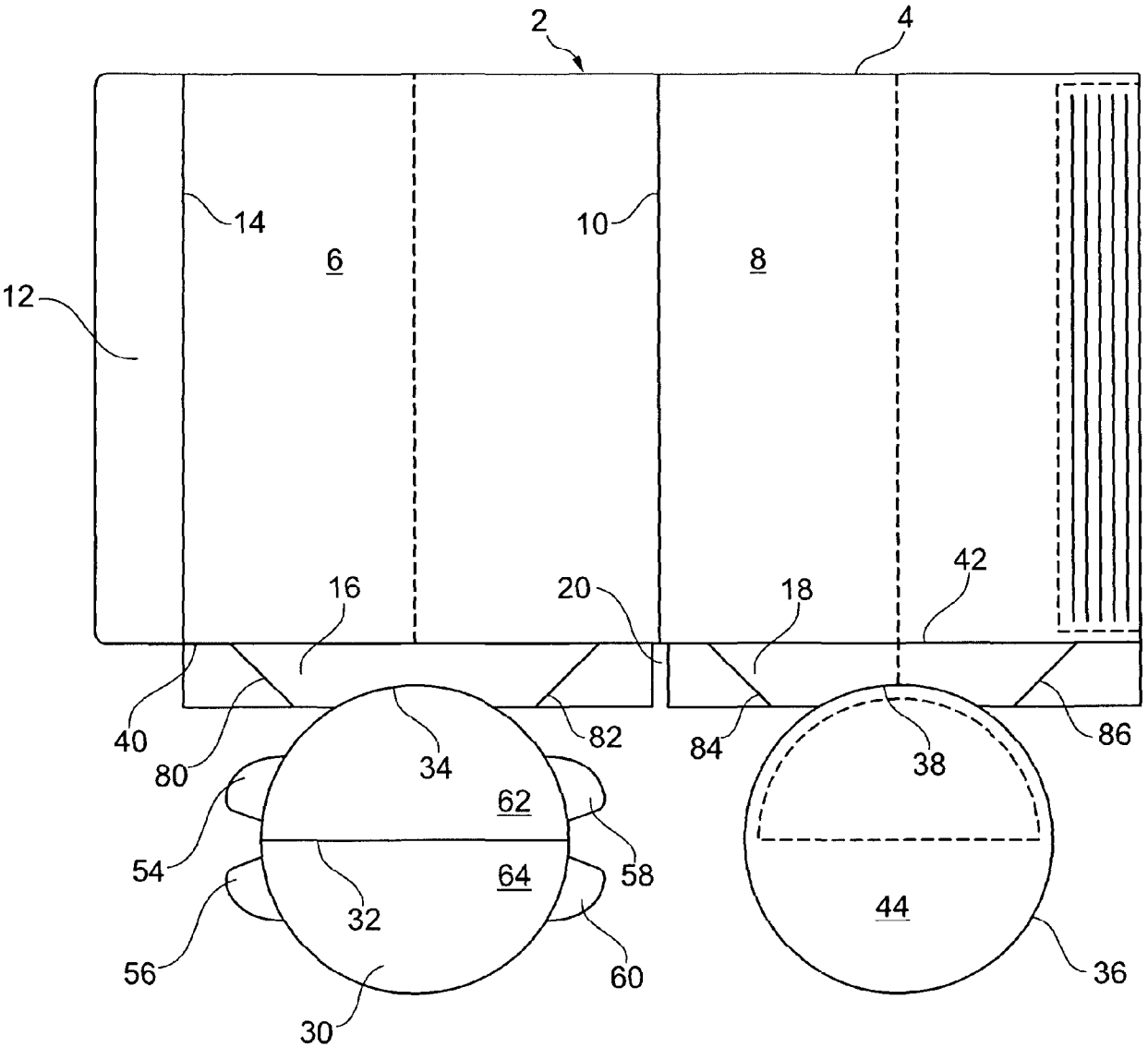
FIG. 3 is a plan view a blank for producing a carton according to the present invention according to a third embodiment.

In an alternative and preferred embodiment as shown in FIG. 3 the free ends of the lower flaps 16,18 are held away from the side wall by use of diagonal crease lines 80, 82, 84, 86. The diagonal weakening lines 80, 82, 84, 86 serve to force the ends of lower panels 16, 18 away from the internal face of first and second panels 6 and 8 respectively.

The manner of construction of the embodiments shown in FIGS. 2 and 3 is essentially similar to that of the embodiment shown in FIG. 1.

Figure 4:
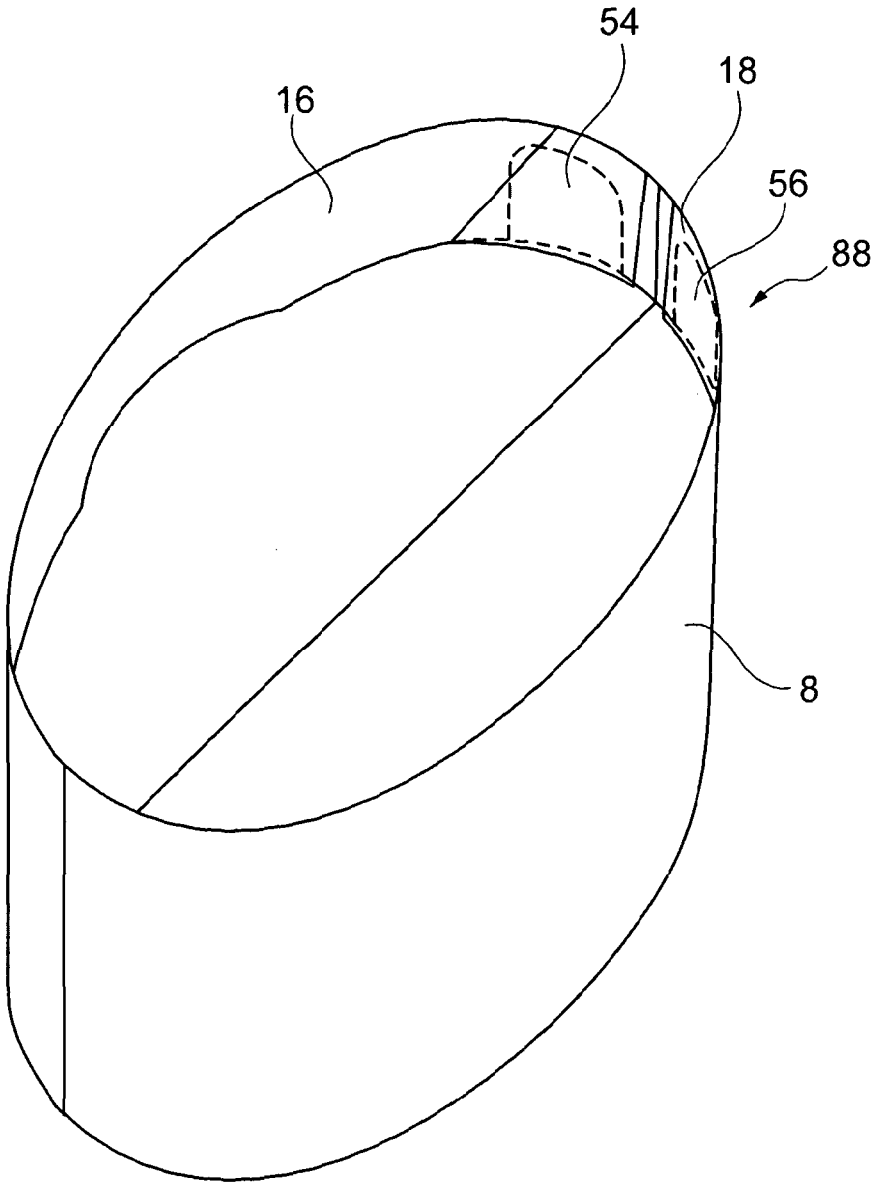
FIG. 4 is a perspective view of a made up carton from the blank of FIG. 3.

Referring to FIG. 4 of the accompanying drawings, there is shown a made up carton 88 in which the strengthening tabs 54, 56 are shown in dashed lines as they lie between the lower flaps 16, 18 and the first and second panels 6, 8.

The resultant base is substantially flat and of uniform thickness and is able to resist pressure and thus damage from any directional force.

A wide variety of shapes can be achieved according to embodiments of the present invention. These can be with two panels or more.

The invention is not restricted to the details of the foregoing embodiment(s). The invention extends to any novel one, or any novel combination, of the features disclosed in this specification, or to any novel one, or any novel combination, of the steps of any method or process so disclosed.

The invention claimed is:

1. A carton comprising a side wall comprising a first panel connected to a second panel, a first lower flap hingedly connected to the first panel, the first and second panels having ends, a second lower flap hingedly connected to the second panel, a hinged locking base panel hingedly connected to the first lower flap and an inner base panel hingedly connected to the second lower flap, a plurality of strengthening tabs attached to the hinged base locking panel or the inner base panel, the first lower flap being folded over and affixed to the first panel, the second lower flap being folded over and affixed to the second panel, the hinged base locking panel being folded along a hinge line thereof and affixed to the inner base panel, in which substantially diagonal weakening lines are positioned on the lower flaps; in which the weakening lines overlie the strengthening tabs when the carton is in its final made up condition.

2. The carton according to claim 1, in which the weakening lines are positioned so as to lie outside of a pocket area occupied by the strengthening tabs when the carton is in its final made up condition.

3. The carton according to claim 1, in which the hinged base locking panel is substantially circular in cross sectional shape and said plurality of strengthening tabs are attached by fold lines positioned either side of a central fold line.

4. The carton according to claim 1, in which the first and/or second lower flaps are glued to the first and/or second panel of the side wall to form a connection in a central section only.

5. The carton according to claim 4, in which the connection between the lower flaps and the side wall is made by a creased line.

6. The carton according to claim 4, in which the connection between the lower flaps and the side wall is made by a combination of a partial cut or score combined with a creased section.

7. The carton according to claim 4, in which the ends of the connection between the lower flaps and the side wall are made by a creased line.

8. The carton according to claim 1, in which the lower flaps have ends and the ends of the lower flaps create a pocket open at one end to cooperate with the plurality of strengthening tabs on the hinged locking base panel when the carton is erected into its final made up state.

9. The carton according to claim 1, in which the hinged locking base panel is hingedly connected to the side wall panel.

10. The carton according to claim 1, in which the hinged base locking panel is hingedly connected to a side panel by a curved hinge connection.

11. The carton according to claim 10, in which a curvature of the hinged connection corresponds to a curvature of the side wall of the carton.

12. A method of construction of a carton from a blank, the blank comprising a side wall having =ends, the side wall comprising a first panel connected to a second panel, a first lower flap hingedly connected to the first panel, a second lower flap hingedly connected to the second panel, a hinged base panel connected to the first lower flap and a base locking panel hingedly connected to the second lower flap, the method comprising the steps of folding the first lower flap above the first panel, folding the second lower flap over the second panel, folding the hinged locking base panel about a central crease line, affixing part of a reverse of the hinged base panel to a corresponding part of a face of the base locking panel comprising folding the first and second panels relatively towards each other, fixing the ends of the side wall and moving the hinged locking base panel and the inner base panel to form a base of the carton, in which substantially diagonal weakening lines are positioned on the lower flaps; in which the weakening lines overlie the strengthening tabs when the carton is in its final made up condition.

13. The method of construction according to claim 12, in which where there are two panels forming the side wall, in which an end of the first panel is affixed to an end of the second panel.

* * * * *